US006082258A

United States Patent [19]

Harrington

[11] Patent Number: 6,082,258

[45] Date of Patent: Jul. 4, 2000

[54] PRINTING PRESS DAMPING SYSTEM

[76] Inventor: Richard Harrington, 13 Oakley Park, Clontarf, Dublin, Ireland

[21] Appl. No.: 09/092,006

[22] Filed: Jun. 5, 1998

[30] Foreign Application Priority Data

Jun. 5, 1997 [IE] Ireland ..... S970423

[51] Int. Cl.[7] ..... B41L 23/00

[52] U.S. Cl. ..... 101/148; 101/178

[58] Field of Search ..... 101/148, 178; 264/25; 492/56, 30, 38

[56] References Cited

U.S. PATENT DOCUMENTS

| | | | |
|---|---|---|---|
| 3,567,923 | 3/1971 | Hutchinson | 250/226 |
| 3,902,417 | 9/1975 | Fischer | 101/148 |
| 3,923,936 | 12/1975 | Davis et al. | 264/25 |
| 3,960,451 | 6/1976 | Wirz et al. | 356/161 |
| 4,022,125 | 5/1977 | Weaver | 101/148 |
| 4,388,864 | 6/1983 | Warner | 101/148 |
| 4,944,223 | 7/1990 | Ishii et al. | 101/148 |
| 5,191,835 | 3/1993 | Blanchard | 101/148 |
| 5,599,266 | 2/1997 | Landl et al. | 492/56 |
| 5,649,481 | 7/1997 | Müller | 101/148 |

FOREIGN PATENT DOCUMENTS

WO91/12964 9/1991 WIPO .

*Primary Examiner*—John S. Hilten
*Assistant Examiner*—Charles H. Nolan, Jr.
*Attorney, Agent, or Firm*—Jacobson, Price, Holman & Stern, PLLC

[57] ABSTRACT

A printing press damping system (10) has a set of rollers (12,1,15,16) to deliver a damping fluid (14) from a trough (11) to a plate cylinder (20) of a printing press. The rollers comprise a fountain roller (12) which is rotatable within the trough to pick up damping fluid (14) which is then transferred to a feed roller (1) then to a distributor roller (15) and finally a damping roller (16) which delivers the damping fluid (14) onto the plate cylinder (20). The fountain roller (12) and distributor roller (15) each have their own drive means. Both the feed roller (1) and damping roller (16) are rotated by frictional engagement with the distributor roller (15). The feed roller (1) has a resiliently deformable outer circumferential surface with a plurality of spaced-apart radial slots which facilitates good grip between the feed roller (1) and the distributor roller (15) and minimises swelling in the feed roller (1) when it heats up in use.

10 Claims, 1 Drawing Sheet

PRINTING PRESS DAMPING SYSTEM

FIELD OF THE INVENTION

This invention relates to damping systems for printing presses, and in particular to lithographic printing presses or web offset presses.

DESCRIPTION OF THE PRIOR ART

In a lithographic printing press a damping system is provided for coating the outer surface of the plate cylinder of the printing press as it rotates with a uniform layer of moisture. A commonly used damping system delivers a damping solution by means of a roller train from a reservoir or trough of damping solution onto a surface of the plate cylinder. A typical conventional damping system has a roller train comprising essentially of a cloth covered damper roller which runs in contact with the plate cylinder, a metal distributor roller in engagement with the damper roller, a cloth covered feed roller which runs in contact with the distributor roller and a fountain roller in contact with the feed roller and rotatable within a trough containing a damping solution. On high speed presses there can be considerable wear to fabric covers particularly on the feed roller which may be driven at a different speed to the fountain roller. Slippage between the feed roller and the fountain roller results in wear and stretching of the fabric cover. The wear can result in unwanted vibration in the damping system. Regular adjustment of the fabric cover on the feed roller is required by the press operator to remove any slack in the fabric. Such interruptions when they interfere with a print run cause unwelcome delays. Further, particularly with longer print runs there can be a fall off in print quality between the start and end of the print run.

Various other known press damping systems are described in Patent Specification Nos. WO 91/12964, U.S. Pat. No. 5,649,481, U.S. Pat. No. 5,191,835 and U.S. Pat. No. 4,944,223.

SUMMARY OF THE INVENTION

According to the invention, there is provided a damping system for a printing press comprising:

- a rotatable fountain roller with associated means for delivering a damping liquid onto a circumferential outer surface of the fountain roller,
- a rotatable feed roller associated with the fountain roller for reception of damping liquid from the fountain roller,
- a rotatable distributor roller mounted between the feed roller and an associated rotatable damper roller, the damper roller for running in contact with the plate cylinder of a printing press for delivery of damping liquid from the feed roller to the plate cylinder,
- characterised in that the feed roller comprises a cylindrical roller having a resiliently deformable circumferential outer surface with a plurality of spaced-apart radial slots in the outer surface of the feed roller.

In a particularly preferred embodiment the radial slots are arranged in circumferentially spaced-apart rows of slots extending between opposite ends of the feed roller.

Preferably the slots in adjacent rows are offset from each other.

Preferably the slots have a width in the range 3 mm–20 mm. The slots may be any suitable shape and size.

In a preferred embodiment the outer surface of the feed roller is a flocked surface.

In a particularly preferred embodiment, a gap is provided between the outer surface of the fountain roller and the outer surface of the feed roller. A gap of about 0.002 inches (0.05 mm) is preferred. However, some variation is possible to keep the feed roller and fountain roller separate but allow the feed roller to take up damping liquid from the fountain roller.

Conveniently the outer surface of the feed roller is of a rubber material either natural or synthetic. Other resilient materials such as plastics materials, polyurethane or polyester for example, could alternatively be used.

In another embodiment drive means is provided for the distributor roller and the feed roller and damping roller frictionally engage the distributor roller to drive the feed roller and the damping roller, and an independent fountain roller drive means is provided for rotation of the fountain roller.

Preferably, the fountain roller drive means is operable to vary the speed of rotation of the fountain roller. Ideally, the fountain roller drive means is a variable speed electric motor. This allows control of the volume of damping liquid delivered to the feed roller.

In another aspect, the invention provides a feed roller for a printing press damping system. The feed roller comprising a cylindrical roller having a resiliently deformable circumferential outer surface with a plurality of spaced-apart radial slots in the outer surface of the feed roller. Preferably, the radial slots are arranged in circumferentially spaced-apart rows of slots extending between opposite ends of the feed roller.

Preferably also, the slots in adjacent rows are offset from each other.

The slots may be any suitable size and shape. Preferably, the slots have a width in the range 3 mm–20 mm.

In a further embodiment, the outer surface of the feed roller is a flocked surface.

In another embodiment, the outer surface of the feed roller is of a rubber or the like material.

BRIEF DESCRIPTION OF THE DRAWINGS

The invention will be more clearly understood by the following description of an embodiment thereof, given by way of example only, with reference to the accompanying drawings, in which.

DETAILED DESCRIPTION OF PREFERRED EMBODIMENTS

Figure 1:
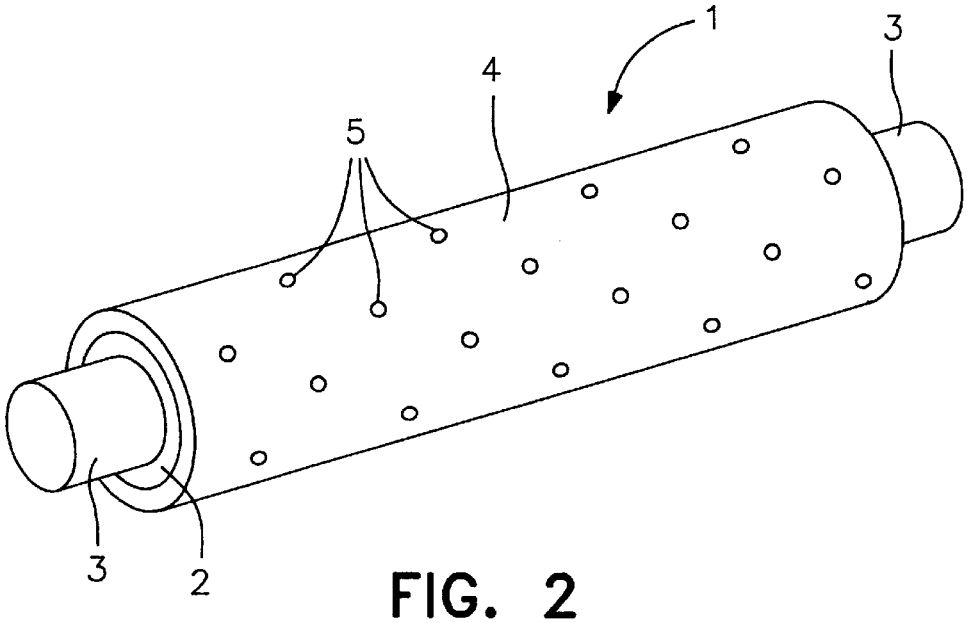
FIG. 1 is a perspective view of a feed roller for a printing press damping system according to the invention.

Referring to the drawings there is illustrated a printing press damping fluid feed roller according to the invention indicated generally by the reference numeral 1. The feed roller 1 is a cylindrical roller having a central cylindrical body 2 with axial bearing shafts 3 at each end. A rubber sleeve 4 is mounted about the central body 2 to provide a resilient outer surface. A plurality of spaced-apart slots 5 are provided in the sleeve 4. Each slot 5 has a diameter of about 6 mm. The outer circumferential surface of the sleeve 4 is a flocked surface.

Figure 2:
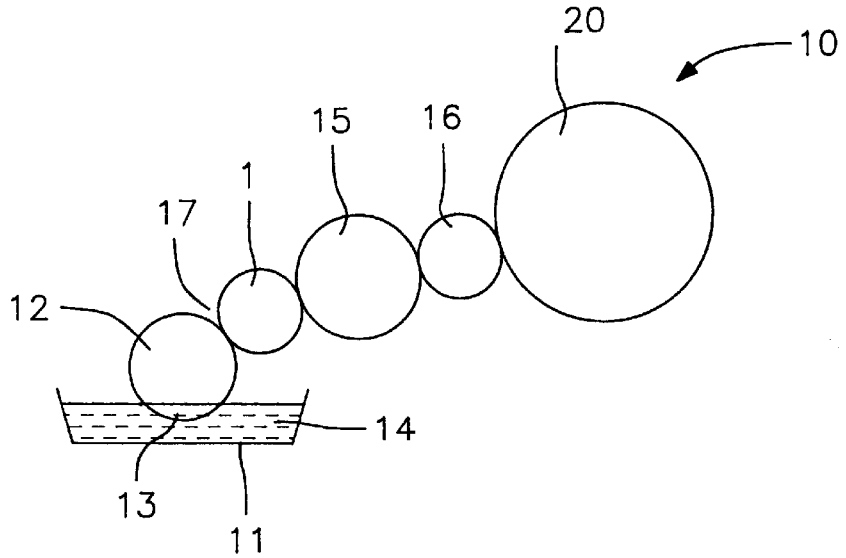
FIG. 2 is a schematic illustration of a damping system incorporating the feed roller according to the invention.

Referring to FIG. 2 a printing press damping system incorporating the feed roller 1 is shown schematically and is indicated generally by the reference numeral 10. The damping system delivers a damping solution, in this case water, by means of a roller train from a water trough 11 onto a surface of a plate cylinder 20 of a printing press. A fountain roller 12 is rotatably mounted such that its bottom 13 dips into water or other damping fluid 14 within the trough 11 to pick up water from the trough 11 on an outer surface of the fountain roller 12. The trough 11 is connected to a water supply (not shown) to replenish the water removed by the fountain roller 12. The outer surface of the fountain roller 12 is a highly polished metallic surface such as a chrome plated surface. A variable speed electric motor (not shown) is provided for rotating the fountain roller 12 at a desired speed for delivery of a required volume of damping liquid to the feed roller 1. A gap 17 of about 0.05 mm is provided between outer surfaces of the fountain roller 12 and feed roller 1.

The feed roller 1 engages against and is driven by a distributor roller 15 which in turn engages with a damping roller 16. The distributor roller 15 has a highly polished metallic surface such as a chrome plated surface. The damping roller 16 has a resilient outer surface which may be of rubber or the like material.

In use, damping fluid, in this case water, is picked up from the water bath 11 by the fountain roller 12 as it rotates and dips into the water bath 11. The feed roller 1 picks up the water from the fountain roller 12 essentially licking water off the fountain roller 12 across the gap 17 and transfers the water to the distributor roller 15 which in turn transfers the water to the damping roller 16. The damping roller 16 which runs in contact with the plate cylinder 20 coats the outer surface of the plate cylinder 20 with the water damping solution.

It will be noted that the distributor roller 15 drives the damping roller 16 and the feed roller 1 is rotated by virtue of its engagement against the distributor roller 15. The fountain roller 12 is independently driven and the speed can be varied as required to supply a desired quantity of water to the feed roller 1.

The slots 5 in the sleeve 4 of the feed roller 1 stop or at least minimise any change in the circumference of the feed roller which will tend to heat up and expand during use. This helps maintain a substantially constant feed of water through the roller train. A further advantage of the slots is that they prevent skidding of the feed roller 1 on the outer polished surface of the distributor roller 15. This again helps to maintain a constant delivery of the water through the roller train. The feed roller firmly engages the surface of the distributor roller 15 even when running wet and the slots 5 prevent skidding or slippage between the feed roller 1 and distributor roller 15. Thus a smooth and reliable transfer of damping fluid from the trough 11 to the damping roller 16 through the roller train is achieved, The regular adjustment which is a feature of damping systems having cloth covered rollers is no longer required.

Figure 3:
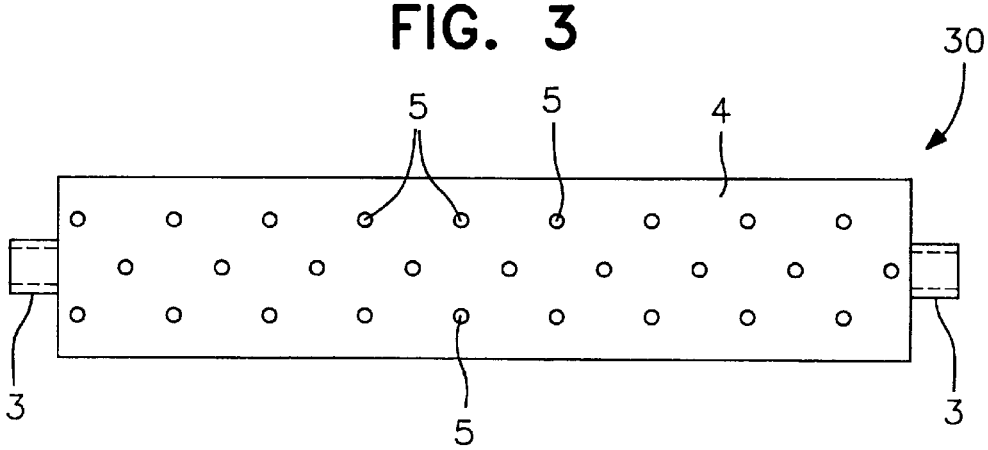
FIG. 3 is an elevational view of another feed roller.

Referring now to FIG. 3, there is shown another damping fluid feed roller 30. In this case, the roller 30 has slots 5 having a diameter of 0.5 inch (12.5 mm). The slots 5 are arranged in rows extending between opposite ends of the roller 30. The spacing between adjacent slots in a row is about 4.5 inches (114 mm). Adjacent rows have the slots 5 offset.

The invention is not limited to the embodiments hereinbefore described which may be varied in both construction and detail.

I claim:

1. A damping system for a printing press, said damping system comprising:

a rotatable fountain roller for receiving a damping liquid onto a circumferential outer surface of the fountain roller, a rotatable feed roller associated with the fountain roller for reception of damping liquid from the fountain roller, a rotatable distributor roller mounted between the feed roller and an associated rotatable damper roller, the damper roller for running in contact with a plate cylinder of a printing press for delivery of damping liquid from the feed roller to the plate cylinder, the feed roller comprising a cylindrical roller having a resiliently deformable circumferential outer surface with a plurality of spaced-apart radial slots in the outer surface of the feed roller, said slots having a width in a range of 3 mm–20 mm.

2. A damping system as claimed in claim 1, wherein the radial slots are arranged in circumferentially spaced-apart rows of slots extending between opposite ends of the feed roller.

3. A damping system as claimed in claim 2, wherein the slots in adjacent rows are offset from each other.

4. A damping system as claimed in claim 1, wherein a gap is provided between the outer surface of the fountain roller and the outer surface of the feed roller.

5. A damping system as claimed in claim 4, wherein the gap is about 0.05 mm.

6. A damping system as claimed in claim 1, wherein the outer surface of the feed roller is of a rubber material.

7. A damping system as claimed in claim 1, wherein a drive device is provided for the distributor roller, and the feed roller and damping roller frictionally engage the distributor roller to drive the feed roller and the damping roller, and an independent fountain roller drive is provided for rotation of the fountain roller.

8. A damping system as claimed in claim 1, wherein the fountain roller drive is operable to vary the speed of rotation of the fountain roller.

9. A damping system as claimed in claim 8, wherein the fountain roller drive is a variable speed electric motor.

10. A feed roller for a printing press damping system, the feed roller comprising a cylindrical roller having a resiliently deformable circumferential outer surface with a plurality of spaced-apart radial slots in the outer surface of the feed roller, the slots having a width in a range of 3 mm–20 mm.

* * * * *